United States Patent [19]

Modahl et al.

[11] 4,354,550

[45] Oct. 19, 1982

[54] HEAT TRANSFER SURFACE FOR EFFICIENT BOILING OF LIQUID R-11 AND ITS EQUIVALENTS

[75] Inventors: Robert J. Modahl, Galesville; Virgil C. Luckeroth, La Crosse, both of Wis.

[73] Assignee: The Trane Company, La Crosse, Wis.

[21] Appl. No.: 261,342

[22] Filed: May 7, 1981

[51] Int. Cl.[3] ..... B05D 3/08; B05D 1/10

[52] U.S. Cl. ..... 165/133; 62/527; 427/422; 427/423

[58] Field of Search ..... 427/422, 423; 165/133; 62/527

[56] References Cited

U.S. PATENT DOCUMENTS

| | | | |
|---|---|---|---|
| 3,340,084 | 9/1967 | Eisenlohr | 427/423 X |
| 3,384,154 | 5/1968 | Milton | 165/1 |
| 3,390,862 | 11/1976 | Dahl et al. | 29/191.2 |
| 3,928,907 | 12/1975 | Chisholm | 427/423 X |
| 3,942,230 | 3/1976 | Nalband | 427/423 X |
| 3,990,862 | 11/1976 | Dahl et al. | 29/191.2 |
| 4,099,481 | 7/1978 | Lyons | 427/423 X |
| 4,232,056 | 11/1980 | Grant et al. | 427/423 X |

FOREIGN PATENT DOCUMENTS

| | | | |
|---|---|---|---|
| 492904 | 5/1953 | Canada | 427/423 |

*Primary Examiner*—Shrive P. Beck

*Attorney, Agent, or Firm*—Carl M. Lewis; Ronald M. Anderson

[57] ABSTRACT

A heat transfer surface for boiling liquid refrigerant 11 and its equivalents and method for producing the surface. The surface comprises a porous, open-cell coating at least 15 mils thick, of oxidized metallic particles which are flame-sprayed onto a metal substrate. This surface includes a substantial number of nucleate boiling cavities having an equivalent radius in the range of 1.5 to 4 mils, which are the result of one or more of the following conditions in the flame-spraying process: (1) The flame-spraying nozzle is oriented so that the metallic particles impact the metal substrate at an angle in the range of 30° to 75°; (2) The metal substrate is preheated to a temperature which is at least 600° F., but below the melting point of the substrate; and (3) The flame-spraying apparatus is positioned such that the metallic particles travel from 3 to 6 inches before impacting the substrate. These conditions create a porous coating with substantially more nucleate boiling cavities of the required size for boiling liquid R-11 than the flame-spraying process disclosed in the prior art.

18 Claims, 7 Drawing Figures

PRIOR ART SURFACE

FIG. 2
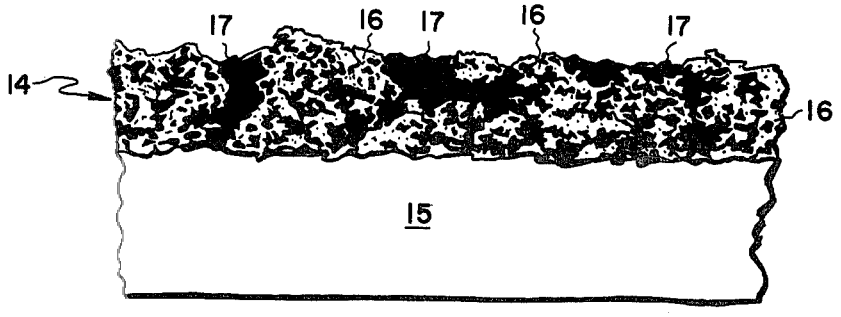
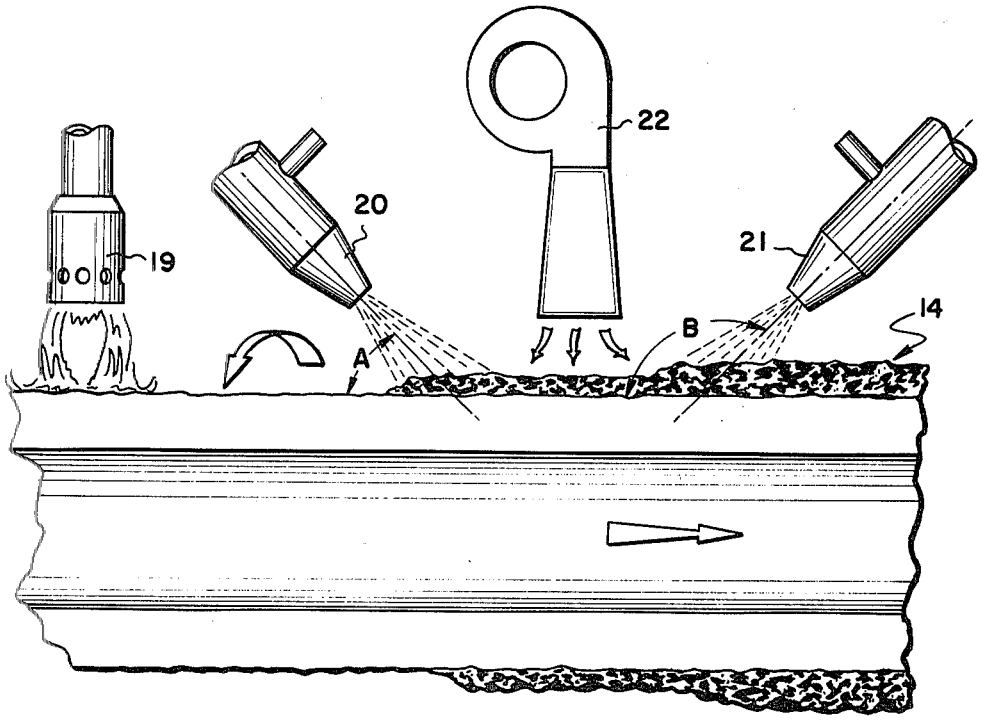
FIG. 3

HEAT TRANSFER SURFACE FOR EFFICIENT BOILING OF LIQUID R-11 AND ITS EQUIVALENTS

DESCRIPTION

1. Technical Field

The subject invention generally pertains to a heat transfer surface and the method by which it is produced, and specifically to a porous boiling surface for efficiently boiling liquid R-11 and its equivalents and the method for flame-spraying such a surface.

2. Background Art

It is well known that a porous boiling surface is much more efficient in transferring heat to a boiling liquid than is a smooth surface. The improvement in efficiency is due to the interconnected nucleate boiling cavities provided in the porous surface, which act as sites for the liquid to vaporize and form bubbles. In a porous coating having the proper physical characteristics, liquid is drawn into the open-celled cavities by capillary action. Ideally, when a vapor bubble forms in a nucleate boiling cavity and breaks away, part of it is retained in the cavity to act as a nucleus or seed for the next bubble. If the cavities are too large, the vapor bubble may escape completely, or capillary force may not effectively draw liquid into the cavity. If the cavities are too small, vapor bubbles may not readily form without substantial superheat of the liquid surrounding the surface.

The above theory is discussed at much greater length in U.S. Pat. Nos. 3,384,154 to Milton and 3,990,862 to Dahl et al. The patent to Milton discloses a method of producing a porous boiling surface by sintering metallic particles of from 1 to 50 micron size to a metal surface. The particles are applied as a slurry mixed with a plastic binder. When the slurry is heated in a furnace, the binder is driven off and the particles are sintered to the metal base.

In the patent to Dahl et al, as in the present invention, metallic particles are flame-sprayed onto a metal substrate to form a porous, open-celled coating. An excess of oxygen, beyond the stoichiometric requirement for complete combustion of the acetylene fuel gas, is provided in the flame-spraying process. As the particles transit from the flame-spraying nozzle to the metal surface, an oxide film is thus formed on the metallic particles due to the heat and excess oxygen in the flame. These particles impact the surface and are adhesively fused to the surface and to each other by the oxide film, thereby forming a porous coating with interconnected opon cells.

It has been experimentally determined that a flame-spraying porous boiling surface, produced as taught by the Dahl et al patent, is very effective in transferring heat to a variety of liquids, particularly refrigerants such as R-12 and R-22. However, that surface has also been shown to be not as efficient for boiling R-11 or R-113, for reasons that are not obvious. The '862 patent to Dahl et al states that the average pore radius of the flame-sprayed surface (prepared as taught in the specification of that patent) is in the approximate range of 0.3 to 6.0 mils. This range should encompass the desired nucleate boiling cavity size required to effeciently boil R-11, yet the surface so-produced lacks the very high heat transfer capability with this liquid that alternative enhanced heat transfer surfaces provide.

When used in a refrigeration cycle, R-11 has one of the highest co-efficient of performance (COP) ratings of any of the commonly used and commercially available refrigerants. It is thus the preferred refrigerant for use in many temperature conditioning systems. There is therefore, a substantial economic motivation to develop a low-cost, highly efficient enhanced boiling surface for use with R-11. For use with R-12 and R-22, the porous boiling surface produced as taught by the Dahl et al patent provides one of the lowest cost, high efficiency heat transfer boiling surfaces available. Alternative surfaces for boiling R-11 are generally higher in cost, but are more efficient for this purpose than the prior art surface.

For these reasons, it is an object of this invention to produce a flame-sprayed porous boiling surface that is as efficient at transferring heat for boiling R-11, R-113, and their equivalents as are higher cost alternatives.

It is a further object of this invention to provide in a flame-sprayed porous surface a greater density of nucleate boiling cavities having an equivalent radius in the range 1.5 to 4 mils to more efficiently transfer heat to a liquid having surface tension characteristics similar to R-11 and R-113.

These and other objects of the subject invention will become evident from the disclosure which follows and by reference to the attached drawings.

DISCLOSURE OF THE INVENTION

The subject invention is a heat transfer surface which is especially efficient in boiling liquid R-11 and its equivalents, and which is produced using a flame-spraying apparatus. The surface is produced by a process which includes preheating a metal substrate to a temperature below its melting point while flame-spraying the metal substrate with metallic particles which are at least partly oxidized by heat and excess oxygen provided in the flame. The flame-spraying apparatus is oriented such that the metallic particles impact the metal substrate at an angle substantially less than 90°. One or more passes of the flame-spraying apparatus deposits on the substrate an open-celled, porous coating at least 15 mils thick comprising the oxidized metallic particles, parts of which are fused to the substrate and to each other. A substantial quantity of nucleate boiling cavities are thus formed by the open cells of the coating, having an equivalent radius of from 1.5 to 4 mils.

BRIEF DESCRIPTION OF THE DRAWINGS

FIG. 2 is a drawing depicting a cross-sectional photomicrograph view of the flame-sprayed surface of the subject invention, at the same magnification factor (35 times) as that in FIG. 1.

FIG. 3 illustrates schematically the process by which the porous coating of the subject invention is applied to a metal substrate, specifically to a rotating tubular structure for use in a heat exchanger.

DESCRIPTION OF THE PREFERRED EMBODIMENTS

Figure 1:
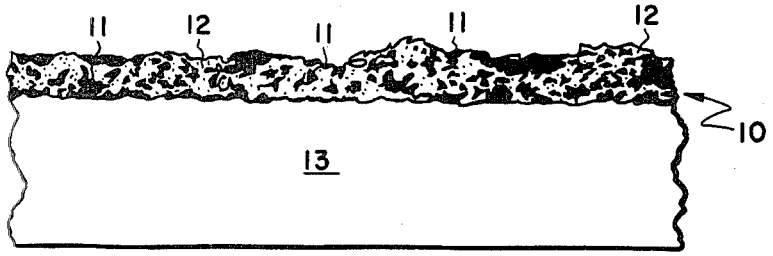
FIG. 1 is a drawing depicting a cross-sectional photomicrograph view of the flame-sprayed surface produced according to the teachings of the prior art.

With reference to FIG. 1, the flame-sprayed porous heat transfer surface 10, produced by the method taught in the prior art patent to Dahl et al illustrates the open-cell structure which forms nucleate boiling cavities 11. This surface 10 comprises oxidized metallic particles 12 which are cohesively bound together and to the metal substrate 13 in a random pattern.

As taught in the '862 patent to Dahl et al, heat transfer surface 10 was produced using a flame-spraying apparatus supplied with acetylene gas as a fuel and oxygen gas as the oxidizer. Substantially pure aluminum particles, ranging in size from −100 to +325 mesh were applied to a copper metal substrate 13 with a spray apparatus oriented at 90° thereto. The flow rates of the acetylene and oxygen gases were set at 18 and 45 cubic feet per hour, respectively. Approximately 3.75 pounds per hour of oxidized metallic particles 12 were applied to the metal substrate 13 from a distance of 12 inches, to form the metal substrate 13. The coating depth or thickness is approximately 12 to 15 mils. Prior to flame-spraying, metal substrate 13 was cleaned and roughened by a grit blasting process. The above conditions of the flame-spraying process used to produce prior art surface 10 are generally in accord with the teachings of the patent to Dahl et al.

For purposes of comparison, the heat transfer surface of the subject invention, generally denoted by reference numeral 14, is illustrated in FIG. 2. Both FIGS. 1 and 2 represent photomicrographs taken of a randomly selected cross section of the heat transfer surfaces, enlarged by the same magnification factor. Likewise, heat transfer surface 14 comprises a copper metal substrate 15 which is flame-sprayed with oxidized aluminum metallic particles 16; however, the process by which these metallic particles 16 are applied, differs significantly from the process taught in the prior art. In comparing the prior art heat transfer surface 10 and the heat transfer surface of the subject invention 14, it should be immediately evident that these two surfaces differ in thickness of the coating, and in the relative size of the nucleate boiling cavities formed therein. Heat transfer surface 14 has a coating applied to a depth of 20 to 28 mils and includes nucleate boiling cavities 11 formed in the prior art surface 10. Although the random structure of prior art surface 10 and the present heat transfer surface 14 are different to describe objectively, it may be said that heat transfer surface 10 has a more compact structure, whereas heat transfer surface 14 appears to have a more open structure, or to be "fluffier" in appearance.

The process used to produce the heat transfer surface 14 differs from that used to produce the prior art surface 10 in the following manner. The copper metal substrate 15 was preheated so that the temperature of its surface at the point of impact of the oxidized metallic particles 16 reached approximately 730° F. The aluminum particle feed rate was set for 5.5 lb/hr. Two passes of the flame-spraying apparatus were used to deposit the coating of the heat transfer surface 14. In the first pass, flame-spraying apparatus was oriented with the nozzle directed generally in the relative axial direction of tube travel so that the aluminum metallic particles 16 impacted the metal substrate 15 at a relative angle of 45° thereto. In addition, the flame-spraying nozzle was positioned substantially closer to the metal substrate 15 than was recommended in the prior art, so that the oxidized metallic particles 16 travelled only approximately 4 inches before impacting the metal substrate 15. In the second pass made with the nozzle directed generally opposite the relative axial direction of tube travel, the oxidized aluminum metallic particles 16 impacted the metal substrate 15 at an angle of approximately 135° relative to the substrate 15, i.e., at an angle of approximately 90° relative to their line of flight in the first pass. All other conditions of the process were substantially the same as those used to produce the prior art heat transfer surface 10.

Although the subject invention may be used in conjunction with both a flat and a curved metal substrate 15, its primary use will likely be in conjunction with heat transfer tubes used in evaporative heat exchangers for boiling a liquid refrigerant, such as R-11 or its equivalents. For such a use, a liquid (e.g., water) circulated through the heat exchanger tubes would be cooled by heat transferred through the metal substrate 15 to evaporate the refrigerant liquid exposed to the nucleate boiling cavities 17 on the external surface of the tube. With reference to FIG. 3, a preferred process is shown by which the flame-sprayed porous coating comprising oxidized metallic particles 16 may be applied to produce a heat exchanger tube 18. In a preferred embodiment of the subject invention illustrated in FIG. 3, the wall of the heat exchanger tube 18 comprises the metal substrate 15. In the Figure, tube 18 is shown moving from left to right, while rotating about its longitudinal axis. In the preferred production process, tube 18 is caused to rotate at approximately 600 rpm and to traverse below the flame-spraying apparatus at approximately 66 inches per minute. The metal substrate 15 of tube 18 is preheated ahead of the flame-spraying apparatus by burner 19 using MAPP gas or acetylene, and oxygen as the fuel and oxidizer, respectively. In the first pass of the flame-spraying process, a flame-spraying nozzle 20 is oriented so that a line through the longitudinal axis of the nozzle forms an angle A equal to approximately 45° relative to the surface of the metal substrate 15. Angle A therefore nominally represents the angle at which the oxidized metallic particles 16 impact the metal substrate 15. The metallic particles 16 travel approximately 4 inches after leaving the flame-spraying nozzle 20 before impacting upon the metal substrate 15. Burner 19 is adjusted in its position and firing rate so that the temperature of the surface of the metal substrate 15 at the point where metallic particles 16 impact is approximately 730° F. It should be understood that the metal substrate attains this temperature as a result of both the heat provided by burner 19 and the heat provided by flame-spraying nozzle 20. Metallic particles 16 are heated and oxidized as they travel to the metal substrate 15 in the flame from nozzle 20, which generates and transfers substantial heat to the substrate in addition to that provided by the gas flame from burner 19.

A second flame-spraying nozzle 21 is oriented so that a line through its longitudinal axis forms an angle B equal to 135°, relative to the surface of the metal substrate 15. As shown in FIG. 3, angles A and B are coplanar; however, it will be apparent that flame-spray nozzle 21 may be located at some other position around the longitudinal axis of heat exchange tube 18 while still providing a flame-sprayed porous layer according to the present invention. If flame-spraying nozzles 20 and 21 are relatively close together, the temperature of the metal substrate 15 may exceed the softening temperature of the material comprising the heat exchange tube 18, causing it to deform. For this reason, a cooling blower 22 may be provided to direct a stream of cooling air onto the porous surface deposited by flame-spraying nozzle 20, prior to the deposition of the porous surface deposited by flame-spraying nozzle 21. Blower 22 cools the metal substrate 15 and the first layer of the surface 14 such that the added heat from the flame spray nozzle 21 does not overheat the heat exchange tube 18. If flame-spray nozzles 20 and 21 are spaced sufficiently far apart either in time and/or distance, blower 22 is not required since the tube 18 will cool between flame-spray nozzles 20 and 21, thereby avoiding this overheating effect. Cooling blower 22 is therefore considered an optional requirement depending upon the relative proximity of flame-spray nozzles 20 and 21 to each other in time and position.

As an alternative to the process shown in FIG. 3, the porous coating 14 may be applied in two separate flame-spraying operations, using only one nozzle. Tube 18 would be reversed between passes or else the nozzle would be reversed. For a sufficiently short heat exchanger tube 18, preheating by burner 19 may not be required prior to the second pass by the flame-spraying nozzle, depending upon the elapsed time between passes.

Furthermore, although the heat exchanger tube 18 is shown as moving past the flame-spraying nozzles 20 and 21, the necessary relative motion may be provided by traversing the burner 19 (and blower 22, if required) and flame-spray nozzles 20 and 21 along an axially stationary, rotating tube 18. Variations such as these will of course be apparent to those skilled in the art.

It has also been determined that the heat transfer surface 14 may be produced by using a single angled application of metallic particles to the metal substrate 15 by flame-spraying nozzle 20. In this case, the rate of traverse is reduced to approximately 33 inches/minute while the metallic particle feed rate is maintained at 6.6 lbs./hr. Since the heat exchanger tube 18 is moving at one-half the speed that it is when coated with a double angle flame-spraying process, the porous heat transfer surface 14 achieves approximately the same depth. However, as will be shown hereinbelow, the single angle flame-spraying process does not produce a heat transfer surface 14 having the same high efficiency for boiling refrigerant 11 as does the surface 14 produced by the double angle process.

In the '862 patent to Dahl et al, it is suggested that spray distance and angle, and substrate surface temperature are variables affecting porosity of the flame-sprayed deposit. This patent also teaches that a distance of generally 12" is appropriate for flame-spraying aluminum particles, to allow a time of flight for the particles to be heated and oxidized. Furthermore, the prior art suggests that the coating may be applied to a thickness of greater or less than 12–15 mils, and that there should be a good distribution of size among the nucleate boiling cavities so that the resulting surface might be usable for boiling a variety of liquids. Nevertheless, the prior art does not specifically teach or suggest a method which may be used to produce a surface suitable for very efficient boiling of refrigerant R-11 and its equivalents. The present invention was developed after substantial experimentation as will be apparent from the following discussion.

It is believed that the heat transfer surface 14 includes substantially more nucleate boiling cavities 17 having an equivalent radius in the range of 1.5 to 4 mils than the prior art heat transfer surface 10. A larger nucleate boiling cavity is required for the formation of vapor bubbles in liquid R-11 than in liquid R-12 or R-22, because of R-11's greater surface tension. An equivalent of R-11 would have a similar surface tension. It is thus believed that the subject invention provides more efficient nucleate boiling in R-11 than the prior art surface 10 because it has a higher proportion of nucleate boiling cavities of the required larger size.

An excellent method of determining the efficiency of a heat transfer surface for boiling a particular liquid involves immersing a tube provided with that surface in the liquid and measuring the temperature difference at boiling, between the liquid surrounding the surface and the surface of the tube, when heat is applied to the internal surface of the tube by means of an electric heater. Typically, several thermocouples are attached to the surface of the test heat transfer tube and their average temperature indication during boiling is compared against the indicated saturation temperature of the liquid in which the tube is immersed. The difference in temperature represents the wall superheat required for a given heat flux. A boiling superheat number low in magnitude indicates that the heat transfer efficiency of the surface under test is relatively high. From an economic standpoint, a low cost, high efficiency heat transfer surface provides a competitive advantage since heat exchangers of a given rating may be built with relatively less heat transfer surface, resulting in less material used and correspondingly lower cost. This is especially significant when a heat transfer surface includes an expensive material such as copper.

Turning now to FIGS. 4–7, the affect of varying several different parameters involved in the flame-spraying process to produce a porous boiling surface are shown in terms of observed boiling superheat when the resulting specimens were tested in liquid R-11. Specimens for which test results are shown in the same Figure were prepared under equivalent conditions except where noted. In all tests, a heat flux equal to 9,000 BTU/hr-Ft$^2$ was provided by the electric heating element sealed in the center of the test specimen. Results are shown for both samples prepared with a single spray angle (dash lines) and samples prepared with two angles (solid lines) relative to the copper metal substrate.

Figure 4:
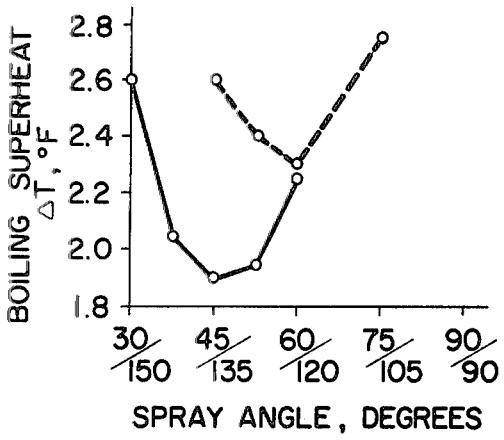
FIG. 4 is a graph showing the relationship of the angle at which the metallic particles impact the metal substrate to the boiling performance of a resulting surface with liquid R-11.

With reference to FIG. 4, none of the samples were preheated prior to the application of the porous boiling surface to the metal substrate. The single angle sample produced with a spray angle equal to 90° has a boiling superheat equal to 2.7° F. and is representative of the performance of the heat transfer surface 10 produced according to the teachings of the prior art. By comparison, a single angle surface produced with the spray angle equal to 60° shows a substantial improvement, having a boiling superheat equal to 2.3° F. A more significant improvement is obtained however, when two angles are used, the first equal to 45° and the second equal to 135° (90° to the first application). It will be understood that two angles are shown on the abscissa of this graph representing nominal angles as shown for angles A and B in FIG. 3. As FIG. 4 shows, even with no preheat, a double angle sample made with spray angles equal to 45°/135° produces a boiling superheat of only 1.9° F.

Figure 5:
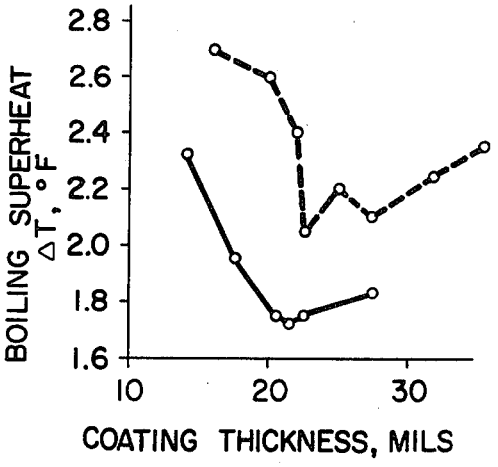
FIG. 5 is a graph showing the effect of the thickness of the flame-sprayed coating relative to the boiling performance of the resulting surface with liquid R-11.

In FIG. 5, results are shown for specimens produced by the single angle process which were not preheated prior to flame-spraying the metallic particles; these specimens were made at mixed traverse speed. The results for specimens produced using the double angle process include some made with preheat; all were made at the same speed. All specimens for which results are shown in FIG. 5 were made using a flame-spraying angle equal to 45°, and in the case of the double angle process, with the second angle equal to 135°, as previously explained. The results of this series of tests indicates that a coating thickness in the range of 20–30 mils provides the lowest boiling superheat in liquid R-11.

Figure 6:
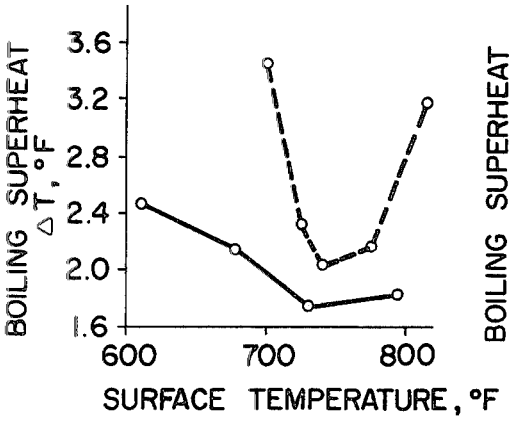
FIG. 6 is a graph showing the relationship between the temperature of the metal substrate at the time the metallic particles impact thereon and the boiling performance of the resulting surface in liquid R-11.

The effects of the surface temperature of the metal substrate at the point at which the metallic particles impact is shown in FIG. 6. In this test, all the specimens were made with the spray nozzle at an angle of 45°, and in the case of the double angle specimens, the second angle was 135°. This graph shows that an optimum surface temperature lies in the range of 700° to 800° F., for both the single angle and double angle processes.

Figure 7:
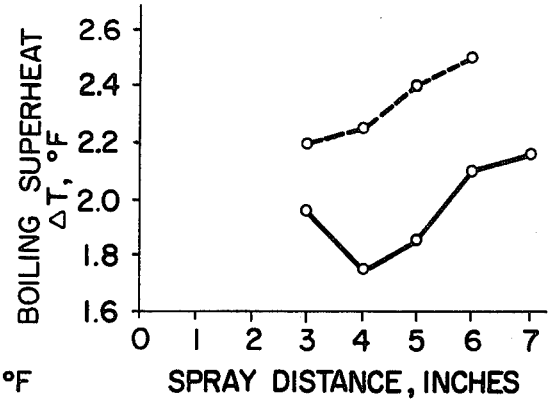
FIG. 7 is a graph showing the effect of spray distance, i.e., the distance which the metallic particles travel between the flame-spraying apparatus and the point of impact on the metal substrate, upon the boiling performance of the resulting surface in liquid R-11.

FIG. 7 shows the effect of the distance between the flame-spray nozzle and the point of impact of the metallic particles on the metal substrate. All specimens for this test were made without preheat with a spray angle equal to 45°, and in the case of the double angle specimens, with the second angle at 135°. As shown, optimum performance occurs at a spray distance of 3 inches for the single angle, and of 4 inches for the double angle specimens.

As FIGS. 4–7 illustrate, the optimum efficiency of a flame-sprayed porous boiling surface for boiling R-11 is achieved by producing that surface using a double angle process, with the flame-spraying apparatus oriented so that the metallic particles impact the metal substrate from a distance of 4 inches at angles of 45° and 135°, respectively, thereby providing a porous coating approximately 21 mils thick, and preheating the metal substrate so the temperature of its surface at the point where the metallic particles impact reaches approximately 730° F. Although these conditions were found optimum specifically for aluminum particles sprayed on a copper metal substrate, it is believed that an improvement in the heat transfer performance for boiling specific liquids such as R-11 might also result if the subject invention were practiced using other materials. Besides copper, the metal substrate might comprise steel, aluminum, or titanium; likewise, copper, steel or nickel metallic particles might be used.

The process for applying a flame-sprayed porous boiling surface to efficiently boil R-11 and its equivalents has been disclosed with detail directed to its use on the exterior surface of heat exchange tubing. Those skilled in the art will understand how this process may be easily adapted to flame-spraying a porous boiling surface which is equally efficient on other types of heat exchange surfaces, such as plates, or finned surfaces having enhanced heat exchange area. It will be understood that modifications to the invention such as these will be apparent to those skilled in the art within the scope of the invention, as defined in the claims which follow.

We claim:

1. A heat transfer surface, especially efficient in boiling liquid refrigerant-11 and its equivalents, produced by a process in which a flame-spraying apparatus is used, said process comprising the steps of:

flame-spraying a metal substrate with metallic particles which are at least partly oxidized by heat and excess oxygen provided in the flame, the flame-spraying apparatus being oriented such that the metallic particles impact the metal substrate at an angle in the range of 45° to 60°, depositing on the substrate an open-cell, porous coating at least 15 mils thick, said coating comprising oxidized metallic particles, parts of which are fused to the substrate and to each other, the open cells of said coating forming a substantial quantity of nucleate boiling cavities having an equivalent radius of 1.5 to 4 mils.

2. A heat transfer surface, especially efficient in boiling liquid refrigerant-11 and its equivalents, produced by a process in which a flame-spraying apparatus is used, said process comprising the steps of:

a. preheating a metal substrate to a temperature in the range 650° F. to 800° F.;

b. flame-spraying the preheated metal substrate with metallic particles which are oxidized by heat and excess oxygen provided in the flame; and c. depositing on the substrate an open-cell, porous coating at least 15 mils thick, said coating comprising oxidized metallic particles, parts of which are fused to the substrate and to each other, the open cells of said coating forming a substantial quantity of nucleate boiling cavities having an equivalent radius of from 1.5 to 4 mils.

3. A heat transfer surface, especially efficient in boiling liquid refrigerant-11 and its equivalents, produced by a process in which a flame-spraying apparatus is used, said process comprising the steps of:

a. preheating a metal substrate to a temperature in excess of 650° F.;

b. flame-spraying the metal substrate with metallic particles which are at least partly oxidized by heat and excess oxygen provided in the flame, the flame-spraying apparatus being oriented such that the metallic particles impact the metal substrate at an angle in the range of 45° to 60°; and c. depositing on the substrate an open-cell, porous coating at least 15 mils thick, said coating comprising oxidized metallic particles, parts of which are fused to the substrate and to each other, the open cells of said coating forming a substantial quantity of nucleate boiling cavities having an equivalent radius of from 1.5 to 4 mils.

4. A heat transfer surface, especially efficient in boiling liquid refrigerant-11 and its equivalents, produced by a process in which a flame-spraying apparatus is used, said process comprising the steps of:

flame-spraying a metal substrate with metallic particles which are at least partly oxidized by heat and excess oxygen provided in the flame, the flame-spraying apparatus being oriented such that the metallic particles impact the metal substrate at an angle in the range of 30° to 60° and in addition, at an angle in the range 120° to 150°; depositing on the substrate an open-cell, porous coating at least 15 mils thick; said coating comprising oxidized metallic particles, parts of which are fused to the substrate and to each other, the open cells of said coating forming a substantial quantity of nucleate boiling cavities having an equivalent radius of 1.5 to 4 mils.

5. A heat transfer surface, especially efficient in boiling liquid refrigerant-11 and its equivalents, produced by a process in which a flame-spraying apparatus is used, said process comprising the steps of:

a. preheating a metal substrate to a temperature in excess of 650° F.;

b. flame-spraying the metal substrate with metallic particles which are at least partly oxidized by heat and excess oxygen provided in the flame, the flame-spraying apparatus being oriented such that the metallic angle in the range of 30° to 60° and in addition, at an angle in the range 120° to 150°; and c. depositing on the substrate an open-cell, porous coating at least 15 mils thick, said coating comprising oxidized metallic particles, parts of which are fused to the substrate and to each other, the open cells of said coating forming a substantial quantity of nucleate boiling cavities having an equivalent radius of from 1.5 to 4 mils.

6. The heat transfer surface of claim 1 or 3 wherein the metallic particles impact the metal substrate at about a 45° angle.

7. The heat transfer surface of claims 1, 2, or 3 wherein the steps of flame-spraying includes depositing the coating of metallic particles in two or more passes.

8. The heat transfer surface of claims 1, 2, 3, 4, or 5 wherein the flame-spraying apparatus is positioned during the process so that the distance the metallic particles travel from the flame-spraying apparatus to their point of impact on the metal substrate is within the range of 3 to 6 inches.

9. The heat transfer surface of claim 2, 3, or 5 wherein the metal substrate is heated so that the temperature at the surface of the metal substrate is about 730° F. where the metallic particles impact thereon.

10. The heat transfer surface of claim 4 or 5 wherein the metallic particles impact the metal substrate at about a 45° angle in one or more passes, and in additional one or more passes, impact the metal substrate and the coating already deposited thereon at about a 135° angle, both angles being measured relative to the metal substrate.

11. The heat transfer surface of claim 1, 2, 3, 4, or 5 wherein the metal substrate is copper or an alloy of copper, and the metallic particles are aluminum or an alloy thereof.

12. The heat transfer surface of claim 3 or 5 wherein the flame-spraying apparatus is oriented at an angle to the metal substrate and passes sufficiently slow in relation thereto that its flame preheats the metal substrate ahead of where the metallic particles impact.

13. A method for producing a heat transfer surface, especially efficient in boiling liquid refrigerant-11 and its equivalents, using a flame-spraying apparatus, comprising the steps of:

flame-spraying a metal substrate with metallic particles which are at least partly oxidized by heat and excess oxygen provided in the flame, the flame-spraying apparatus being oriented such that the metallic particles impact the metal substrate at an angle in the range 45° to 60° thereby depositing on the substrate an open-cell, porous coating at least 15 mils thick, said coating comprising oxidized metallic particles, parts of which are fused to the substrate and to each other, the open cells of said coating forming a substantial quantity of nucleate boiling cavities having an equivalent radius of 1.5 to 4 mils.

14. A method for producing a heat transfer surface, especially efficient in boiling liquid refrigerant-11 and its equivalents, using a flame-spraying apparatus, comprising the steps of:

a. heating a metal substrate to a temperature in the range 650° F. to 800° F.;

b. flame-spraying the heated metal substrate with metallic particles which are oxidized by heat and excess oxygen provided in the flame; and c. depositing on the substrate an open-cell, porous coating at least 15 mils thick, comprising the oxidized metallic particles, parts of which are fused to the substrate and to each other, the open cells of said coating forming a substantial quantity of nucleate boiling cavities having an equivalent radius of from 1.5 to 4 mils.

15. A method for producing a heat transfer surface, especially efficient in boiling liquid refrigerant-11 and its equivalents, using a flame-spraying apparatus, comprising the steps of:

a. preheating a metal substrate to a temperature in excess of 650° F.;

b. flame-spraying the metal substrate with metallic particles which are at least partly oxidized by heat and excess oxygen provided in the flame, the flame-spraying apparatus being oriented such that the metallic particles impact the metal substrate at an angle in the range of 45° to 60°; and c. depositing on the substrate an open-cell, porous coating at least 15 mils thick, comprising the oxidized metallic particles, parts of which are fused to the substrate and to each other, the open cells of said coating forming a substantial quantity of nucleate boiling cavities having an equivalent radius of from 1.5 to 4 mils.

16. A method for producing a heat transfer surface, especially efficient in boiling liquid refrigerant-11 and its equivalents, using a flame-spraying apparatus, comprising the steps of:

flame-spraying a metal substrate with metallic particles which are at least partly oxidized by heat and excess oxygen provided in the flame, the flame-spraying apparatus being oriented such that the metallic particles impact the metal substrate at an angle in the range of 30° to 60° and in addition, at an angle in the range 120° to 150°, thereby depositing on the substrate an open-cell, porous coating at least 15 mils thick; said coating comprising oxidized metallic particles, parts of which are fused to the substrate and to each other, the open cells of said coating forming a substantial quantity of nucleate boiling cavities having an equivalent radius of 1.5 to 4 mils.

17. A method for producing a heat transfer surface, especially efficient in boiling liquid refrigerant-11 and its equivalents, using a flame-spraying apparatus, comprising the steps of:

a. preheating a metal substrate to a temperature in excess of 650° F.;

b. flame-spraying the metal substrate with metallic particles which are at least partly oxidized by heat and excess oxygen provided in the flame, the flame-spraying apparatus being oriented such that the metallic particles impact the metal substrate at an angle in the range of 30° to 60° and in addition, at an angle in the range 120° to 150°; and c. depositing on the substrate an open-cell, porous coating at least 15 mils thick, comprising the oxidized metallic particles, parts of which are fused to the substrate and to each other, the open cells of said coating forming a substantial quantity of nucleate boiling cavities having an equivalent radius of from 1.5 to 4 mils.

18. The method of claims 13, 14, 15, 16, or 17 including the step of positioning the flame-spraying apparatus so that the distance the metallic particles travel from the flame-spraying apparatus to their point of impact on the metal substrate is within the range of 3 to 6 inches.

* * * * *